US008682185B2

(12) United States Patent
Andou et al.

(10) Patent No.: US 8,682,185 B2
(45) Date of Patent: Mar. 25, 2014

(54) IMAGE FORMING APPARATUS MAINTAINING CLEAN BACK SURFACE OF RECORDING MATERIAL

(75) Inventors: Yoshihiro Andou, Osaka (JP); Masayuki Yamada, Osaka (JP); Lin Lu, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 231 days.

(21) Appl. No.: 13/218,842

(22) Filed: Aug. 26, 2011

(65) Prior Publication Data

US 2012/0051769 A1 Mar. 1, 2012

(30) Foreign Application Priority Data

Aug. 31, 2010 (JP) ..... 2010-194251

(51) Int. Cl.
*G03G 15/00* (2006.01)

(52) U.S. Cl.
USPC ..... 399/49

(58) Field of Classification Search
USPC ..... 399/49, 308, 313
See application file for complete search history.

(56) References Cited

U.S. PATENT DOCUMENTS

2004/0081475 A1* 4/2004 Phillips et al. ..... 399/49
2006/0127114 A1* 6/2006 Mizuno ..... 399/49
2009/0087231 A1* 4/2009 Masaki et al. ..... 399/308

FOREIGN PATENT DOCUMENTS

JP 59189382 A * 10/1984 ..... G03G 21/00
JP 2001-92198 4/2001

* cited by examiner

*Primary Examiner* — Quana M Grainger
(74) *Attorney, Agent, or Firm* — Pearl Cohen Zedek Latzer Baratz LLP

(57) ABSTRACT

An image forming apparatus includes: an image forming unit having an image supporting body and a developing unit; a transfer roller; a transfer belt having a conveying surface onto which a recording material is placed; a cleaning unit; a density detection unit detecting toner density on the conveying surface; a calibration processing unit that executes a calibration process; and a control unit that: in a state in which the calibration process has been executed, instructs the image forming unit to adjust the toner density of the toner image formed on the image supporting body based on the toner density detected by the density detection unit; and in a state in which the calibration process has not been executed, switches the cleaning unit to the cleaning state or maintains the cleaning unit in the non-cleaning state based on the toner density detected by the density detection unit.

5 Claims, 6 Drawing Sheets

IMAGE FORMING APPARATUS MAINTAINING CLEAN BACK SURFACE OF RECORDING MATERIAL

This application is based on and claims the benefit of priority from Japanese Patent Application No. 2010-194251, filed on 31 Aug. 2010, the content of which is incorporated herein by reference.

BACKGROUND OF THE INVENTION

1. Field of the Invention

The present invention relates to an image forming apparatus.

2. Related Art

An image forming apparatus employing xerography has been known. Such an image forming apparatus of xerography forms a toner image on a recording material (paper) in the following steps. First, a charging device charges an image supporting body (for example, a photoreceptor drum) in advance. Next, an exposure device irradiates a surface of the photoreceptor drum with lazer light. In this way, an electrostatic latent image is formed on a surface of the photoreceptor drum. In addition, by applying a developing bias voltage in a developing device supporting toner, the toner that is charged in advance attaches to the electrostatic latent image to form a toner image.

Subsequently, a transfer unit transfers the toner image to the recording material directly or via an intermediate transfer belt. A fixing unit fixes the toner image transferred to the recording material onto the recording material.

The image forming apparatus thus forms an image on a surface of the recording material.

In order to form an image stably and without unevenness on the surface of the recording material, it is necessary to control toner density of the toner image formed on the image supporting body at a predetermined stage.

Given this, a technology of calibrating image density using a density sensor is disclosed (related Art 1). More specifically, in an image forming apparatus that forms an image on a recording material via an intermediate transfer belt, the image forming apparatus forms a reference image (for example, a toner patch) on a photoreceptor drum and transfers the reference image to the transfer belt. Next, the image forming apparatus detects a toner amount of the reference image by irradiating the reference image with light. And then, the image forming apparatus obtains a calibration amount for toner density, based on a result of detection.

However, in a case of an image forming apparatus that transfers a toner image directly to the recording material, upon transfer of the toner image to the recording material, toner migrating from the photoreceptor drum to the recording material may attach to a conveying surface of a conveying belt that conveys the recording material (for example, fogging toner which is attaced on photoreceptor drum in a interval of conveyning sheets of paper). Such a residual toner attached to the conveying surface may contaminate a reverse face of the recording material.

SUMMARY OF THE INVENTION

An objective of the present invention is to provide an image forming apparatus that can prevent contamination of a reverse face of the recording material.

The present invention is relatd to an image forming apparatus including: an image forming unit having an image supporting body and a developing unit; a transfer roller; a transfer belt having a conveying surface onto which a recording material, to which the toner image is directly transferred at a transfer position, is placed; a cleaning unit that can be switched between a cleaning state and a non-cleaning state; a density detection unit detecting toner density on the conveying surface; a calibration processing unit that executes a calibration process; and a control unit that: in a state in which the calibration process has been executed, instructs the image forming unit to adjust the toner density of the toner image formed on the image supporting body based on the toner density detected by the density detection unit; and in a state in which the calibration process has not been executed, switches the cleaning unit to the cleaning state or maintains the cleaning unit in the non-cleaning state based on the toner density detected by the density detection unit.

DETAILED DESCRIPTION OF THE INVENTION

A preferred embodiment of the present invention is described hereinafter with reference to the drawings.

Figure 1:
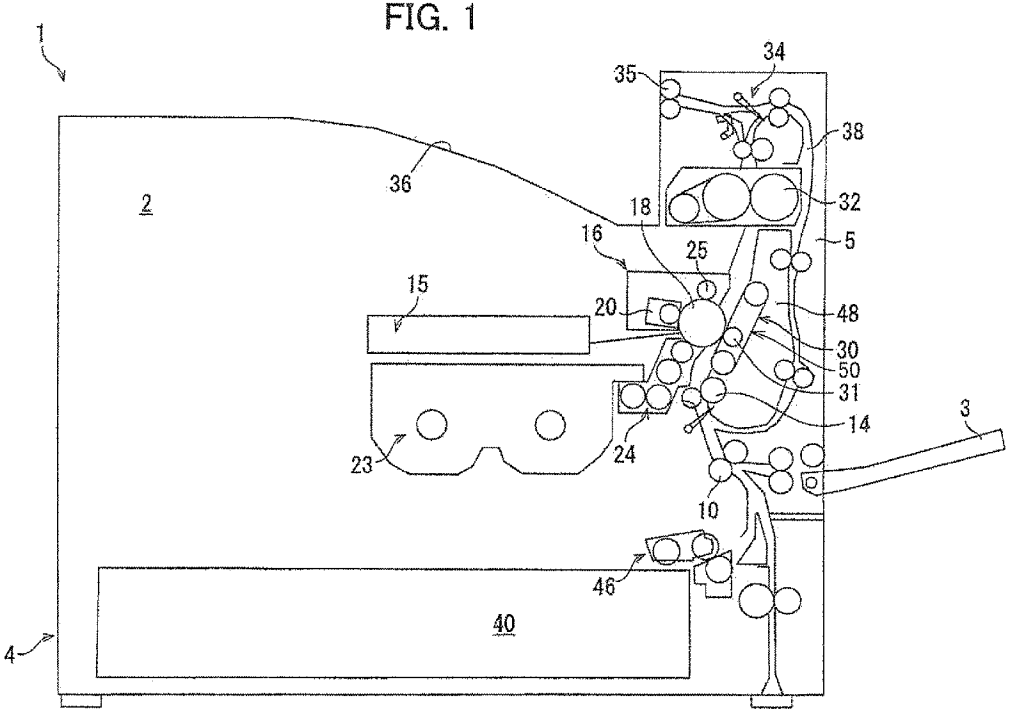
FIG. 1 is a schematic configuration diagram of a printer of the present embodiment.

FIG. 1 schematically shows a configuration of a printer 1 for black and white printing as an example of the image forming apparatus. A cross section shown in FIG. 1 is taken from a left side face of the printer 1. Accordingly, a front face of the printer 1 is shown on a right side and a back face thereof is shown on a left side in FIG. 1.

As shown in FIG. 1, an ejected paper tray 36 is provided on an upper side of an apparatus main body 2 of the printer 1. A plurality of operation keys for various operations by a user and a front cover 5 on which a display for displaying a variety of information are provided in the vicinity of the ejected paper tray 36.

In addition, a paper feeding cassette 4 is disposed on a lower side of the apparatus main body 2. A paper feeding cassette 4 has a storage portion 40. In the storage portion 40, a plurality of sheets of paper (recording material) are stored in a stacked state. In the storage portion 40, paper of a plurality of standard sizes can be stored.

On an upper right side of the storage portion 40 in FIG. 1, a paper feeding roller 46 is provided. The paper is fed by the paper feeding roller 46 toward an upper right side of the paper feeding cassette 4. Subsequently, the paper thus fed is conveyed upward inside the apparatus main body 2, along a front face of the printer 1.

In addition, the paper feeding cassette 4 is configured to be slidable toward the front face of the printer 1, in other words toward a right side in FIG. 1. In such a state of the paper feeding cassette 4 having been slid outwards, a user can replenish and exchange the paper in the storage portion 40.

Inside of the apparatus main body 2, a conveyance roller 10, a resist roller 14, an image forming unit 16 and a transfer unit 30 are disposed in this order on a downstream side of the paper feeding cassette 4 in a paper conveying direction.

The image forming unit 16 has a photoreceptor drum (image supporting body) 18. The photoreceptor drum 18 is rotatably disposed and driven by a drum motor counterclockwise in FIG. 1. The photoreceptor drum 18 of the present embodiment is an a-Si drum having an amorphous silicon layer on a surface thereof.

As shown in FIG. 1, an exposure unit 15 is provided on a left side of the photoreceptor drum 18. The exposure unit 15 emits laser light toward the photoreceptor drum 18. In addition, as shown in FIG. 1, a charging device 20, a developing device 24, a transfer roller 31 of the transfer unit 30, and a cleaning unit 25 are provided at arbitrary positions on the periphery of the photoreceptor drum 18.

The charging device 20 of the present embodiment is positioned on an upper left side of the photoreceptor drum 18 in FIG. 1. The charging device 20 includes a charging roller contacting the photoreceptor drum 18 and a friction roller that cleans a surface of the charging roller by polishing. The charging device 20 charges the surface of the photoreceptor drum 18.

The developing device 24 is disposed on a lower left side of the photoreceptor drum 18. The developing device 24 has a developing roller that faces the photoreceptor drum 18. The developing roller is driven clockwise in FIG. 1 by a developing motor.

In addition, a black toner container 23 is provided between the exposure unit 15 and the paper feeding cassette 4.

Here, the transfer unit 30 of the present embodiment has a transfer belt 50 that grips and conveys the paper by an electrostatic force, as described later. The transfer belt 50 is disposed on a lower right side of the photoreceptor drum 18 in FIG. 1 so as to be contactable with the photoreceptor drum 18, and runs (rotates) clockwise in FIGS. 1 and 3 by a belt motor.

The transfer belt 50 is interposed between the photoreceptor drum 18 (image supporting body) and the transfer roller 31 at a transfer position TS. In addition, the transfer belt 50 has a conveying surface onto which paper (recording material), to which the toner image is directly transferred at the transfer position TS, is placed. The transfer belt 50 is a circular belt that runs in a predetermined conveying direction (clockwise in FIGS. 1 and 3).

The transfer belt 50 is configured to be able to be in pressure-contact against the photoreceptor drum 18 by puressure of the transfer roller 31 from a lower right side in FIG. 1. The transfer belt 50 and the photoreceptor drum 18 form a nip portion for transferring the toner image to paper at the transfer position TS. The transfer roller 31 of the present embodiment is configured by forming foamed rubber of EPDM (Ethylene-propylene-diene mischpolymer) on a metallic shaft (appropriately 8 mm in diameter), to be appropriately 14 mm in diameter. The transfer roller 31 presses a reverse surface of the transfer belt 50 toward the photoreceptor drum 18.

Here, the transfer belt 50 and the paper placed thereon are interposed between the photoreceptor drum 18 and the transfer roller 31 at the transfer position TS. The paper is placed on the placing surface (conveying surface) on a side to the photoreceptor drum 18, at the transfer position TS. As a result, the toner image formed on the photoreceptor drum 18 is transferred to the paper placed on the placing surface (conveying surface) of the transfer belt 50.

In addition, on a downstream side of the transfer portion 30 in the paper conveying direction, a fixing unit 32, an ejection branch portion 34 and an ejection roller 35 are disposed in this order (FIG. 1).

In the present embodiment, a conveying unit 48 that is withdrawable with respect to the apparatus main body 2 along with the transfer unit 30 is disposed between the transfer unit 30 and a manual feeding tray 3. Seen from the conveying unit 48, a duplex printing paper path 38 is formed on a front face side of the apparatus main body 2. The duplex printing paper path 38 branches off from the ejection branch portion 34 on a front face side of the apparatus main body 2, and extends downward to connect to an upstream side of the resist roller 14.

As the transfer belt 50, an endless belt obtained by overlapping and joining both end portions of a rubber sheet material, and a seamless belt without a seam can be used, for example.

The transfer unit 30 includes a driving roller 52 and a driven roller 54 that is disposed obliquely above the driving roller 52.

The transfer belt 50 is stretched around the driving roller 52 and the driven roller 54 thereby composing a part of the paper path, and is disposed obliquely with respect to a perpendicular direction.

Figure 2:
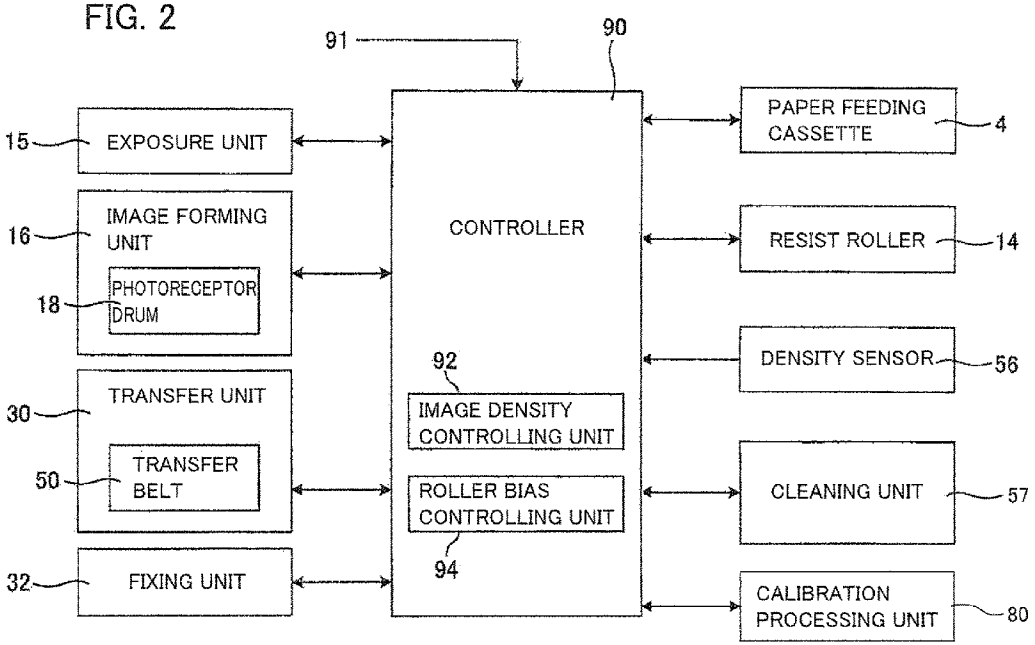
FIG. 2 is a configuration diagram of the printer.

As shown in FIG. 2, the transfer belt 50 is an open belt stretched around the driving roller 52 disposed on a side to the resist roller 14 in a lower part and the driven roller 54 disposed on a side to the fixing unit 32 in an upper part, and is disposed to be movable clockwise in a slanted state.

As the rubber sheet material, acrylonitrile-butadiene rubber (NBR) is used, for example, and a surface thereof is coated with a fluorinated coating (for example, polytetrafluoroethylene (PTFE)).

Frictional charging characteristics of the transfer belt 50 is of a reverse polarity to frictional charging characteristics of the toner attached to the electrostatic latent image on the photoreceptor drum 18.

A voltage of a reverse polarity to that of the toner attached to the electrostatic latent image is applied between the transfer roller 31 and the photoreceptor drum 18. In other words, in a case in which a positively charged toner is used in the present embodiment, a voltage of a negative polarity is applied to the transfer roller 31. As a result, the positively charged toner on the photoreceptor drum 18 moves away from the photoreceptor drum 18 and toward the paper on the transfer belt 50.

The positively charged toner separating from the photoreceptor drum 18 and a negatively charged toner generated due to increase in potential on the surface of the photoreceptor drum 18 may attach as a residual toner to the conveying surface (paper placing surface, an outer surface, a surface on the photoreceptor drum side) of the transfer belt 50. The positively charged toner may leave a positively charged residual toner, which is gradually additionally charged by rotational movement of the transfer belt 50.

Figure 3:
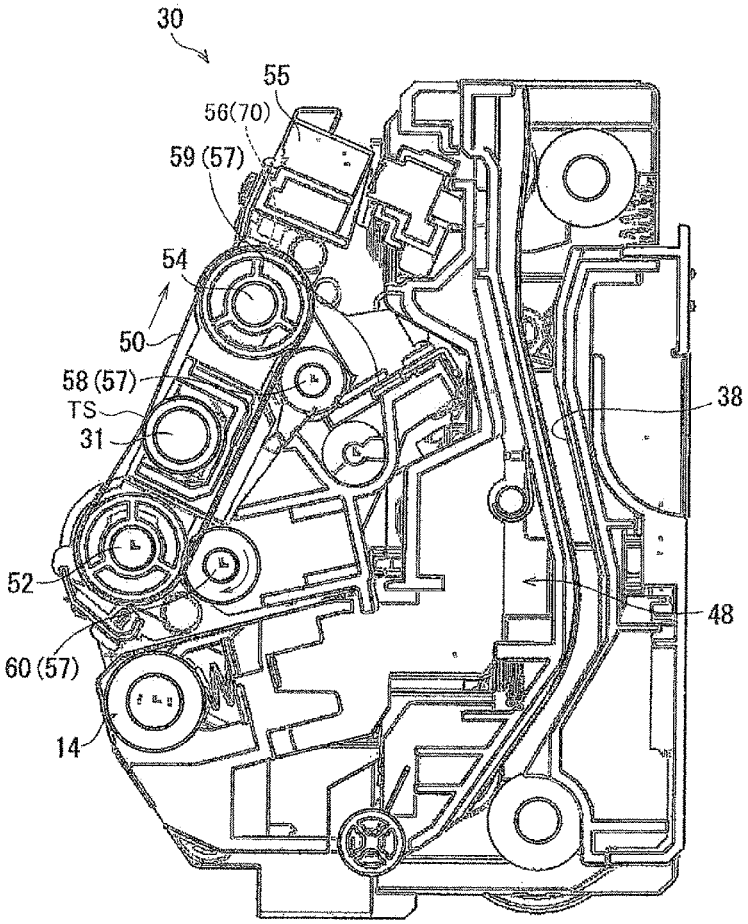
FIG. 3 is an explanatory diagram of the vicinity of a transfer unit.

The cleaning unit 57 removes the residual toner remaining on the conveying surface of the transfer belt 50 (see FIG. 3).

The cleaning unit 57 of the present embodiment includes a cleaning roller 58, a blade 59, a high-voltage substrate, an auxiliary cleaning unit 60 and the like.

The cleaning roller 58 is disposed in the vicinity of the driven roller 54 on a downstream side thereof in the running direction (conveying direction, rotational direction) of the transfer belt 50 (see FIG. 3), and collects and removes the residual toner, which attaches to the conveying surface for conveying the paper, from the conveying surface by an electrostatic force.

More specifically, the cleaning roller 58 is formed of metal (for example, SUS430), extends in a width direction of the transfer belt 50, and is configured to be rotatable. In addition, the cleaning roller 58 rotates counterclockwise in FIG. 3 at the same rate as, or at a greater rate than, the transfer belt 50 (for example, linear speed ratio of 1.0 to 1.2); and contacts the conveying surface of the transfer belt 50 in a trailing direction.

The blade 59 is formed of urethane, extends in the width direction of the transfer belt 50, and contacts the cleaning roller 58 in a counter direction at a reverse side to the conveying surface of the transfer belt 50.

The driven roller 54 is earthed. A voltage of a reverse polarity to that of the toner attached to the electrostatic latent image on the photoreceptor drum 18 is applied between the cleaning roller 58 and the driven roller 54 by the high voltage substrate, thereby forming an electric field from the conveying surface of the transfer belt 50 toward the cleaning roller 58.

The positively charged toner attached to the conveying surface of the transfer belt 50 is thus collected therefrom and contacts the cleaning roller 58. The blade 59 scrapes the toner attached to the cleaning roller 58 thereaway, and collects to a collection container.

On the other hand, the auxiliary cleaning unit 60 is disposed on a downstream side of the cleaning roller 58 and in the vicinity of the driving roller 52 on an upstream side thereof in the running direction of the transfer belt 50. The auxiliary cleaning unit 60 extends in the width direction of the transfer belt 50 and is configured to be rotatable.

The auxiliary cleaning unit 60 is composed of a brush having frictional charging characteristics of a reverse polarity (negative charge in the present embodiment) to that of a proper charged toner. The auxiliary cleaning unit 60 rotates clockwise in FIG. 3 at the same rate as the transfer belt 50 (linear speed ratio of 1.0); and contacts the conveying surface of the transfer belt 50 in a counter direction.

As a result, the negatively charged toner attached to the conveying surface, which has passed through the cleaning roller 58, is agitated by the auxiliary cleaning unit 60 and entirely processed to be a positively charged toner.

The conveying surface onto which the positively charged toner, which has thus been processed, receives the paper in the vicinity of the resist roller 14 and runs toward the photoreceptor drum 18.

Subsequently, by applying to the transfer roller 31 a voltage of a reverse polarity to the toner, the positively charged toner on the photoreceptor drum 18 moves away from the photoreceptor drum 18 toward the paper, while the positively charged toner attached to the conveying surface of the transfer belt 50 continues to be attached thereto.

And then, since the electric field from the conveying surface toward the cleaning roller 58 is generated by the high voltage substrate, the cleaning unit 57 can collect the positively charged toner attached to the conveying surface. Thereafter, the residual toner cannot easily attach to the conveying surface.

The cleaning unit 57 is configured to be switched between a cleaning state in which the cleaning unit 57 removes the toner attached to the conveying surface and a non-cleaning state in which the cleaning unit 57 does not remove the toner attached to the conveying surface.

The cleaning unit 57 is switched to the cleaning state or maintained in the non-cleaning state based on an instruction from the controller 90.

More specifically, in a state in which a calibration processing unit 80 (described later) has not executed a calibration process for adjusting the toner density, the cleaning unit 57 switches to the cleaning state or maintains to be in the non-cleaning state based on the toner density detected by a density sensor 56.

Figure 4:
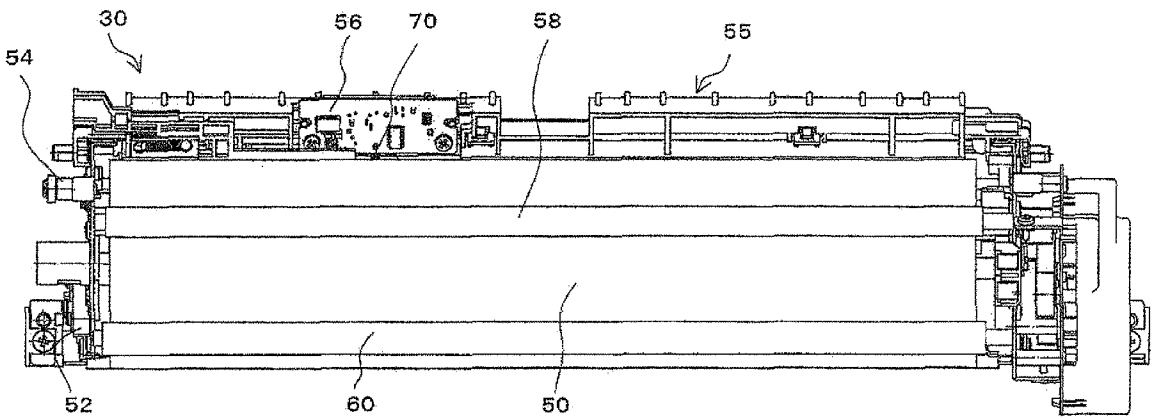
FIG. 4 is a perspective view of the transfer unit.

The density sensor (density detection unit) 56 is provided in the transfer unit 30 of the present embodiment (see FIGS. 2 and 4).

For calibrating the image density of the photoreceptor drum 18, first, a reference image (for example, a toner patch) for adjusting image is formed on the photoreceptor drum 18. The reference image is then transferred to the conveying surface of the transfer belt 50. The density sensor 56 (detection unit 70) then measures the toner density of the reference image transferred to the conveying surface. The density sensor 56 is attached to a supporting mount 55 that is provided on an upper right side of the driven roller 54 in FIG. 3.

More specifically, as shown in FIGS. 3 and 4, the density sensor 56 detects the toner density on the conveying surface of the transfer belt 50, on a downstream side of the transfer position of the toner image and an upstream side of a cleaning position of the cleaning roller 58.

Figure 5:
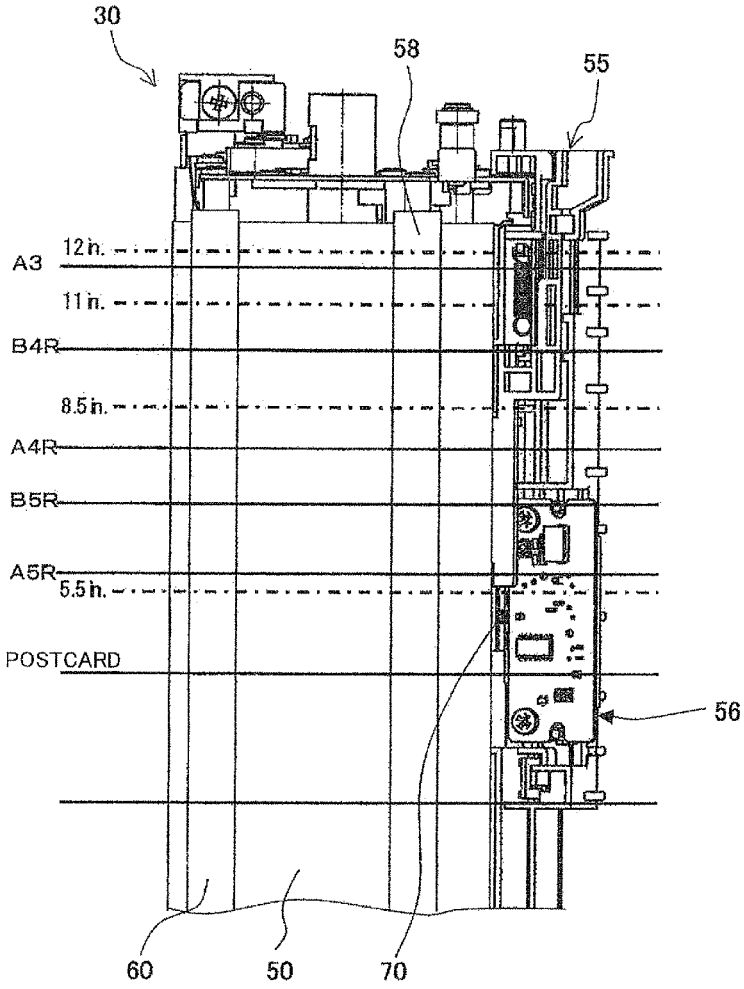
FIG. 5 is a partial enlarged view of the transfer unit.

The density sensor 56 of the present embodiment has the detection unit 70 being disposed at a position not aligned with an edge position of a standard-size paper (a position corresponding to an outer edge of the standard-size paper), as illustrated in FIG. 5 enlarging a left portion of FIG. 4. The detection unit 70 detects the toner density of the transfer belt 50 at a position not aligned with a position corresponding to the outer edge of the standard-size paper in a width direction orthogonal to the running direction.

More specifically, the edge positions of A-sized and B-sized papers used in Japan are shown by solid lines in FIG. 5. The edge positions of so-called legal-sized papers used in U.S. and the like are shown by dashed-dotted lines. Here, the detection unit 70 of the present embodiment is disposed at a position that does not overlap any of the edge positions.

In the present embodiment, the detection unit 70 is composed of a light emitting portion and a light receiving portion. In the detection unit 70, the light emitting portion emits measuring light toward the conveying surface of the transfer belt 50 and the light receiving portion detects reflected light reflected by the toner of the reference image on the conveying surface.

In a case in which toner amount of the reference image is large, the measuring light is scattered by the toner, and intensity of light received by the light receiving portion decreases. A measurement result by the density sensor 56 is input to the controller 90 (FIG. 2). An image density control unit (control unit) 92 included in the controller 90 measures the toner amount of the reference image based on a difference between intensity of regular reflected light and intensity of diffused reflected light, for example. A calibration amount for density is thus obtained. Based on the calibration amount thus obtained, the image density is adjusted in the image forming unit 16.

In the present embodiment, the measurement result by the density sensor 56 is also used for detection of a cleaning status of the conveying surface of the transfer belt 50.

The calibration processing unit 80 executes a calibration process for calibrating the toner density of the toner image formed on the photoreceptor drum 18.

The calibration process (calibration of the toner density on the photoreceptor drum 18) is executed based on the toner density of the reference image formed on the conveying surface of the transfer belt 50. More specifically, the printer 1 first forms the reference image on the conveying surface of the transfer belt 50. Next, the density sensor detects the toner amount of the reference image by irradiating the reference image with light, for example. The image density control unit 92 obtains the calibration amount for the density and calibrates the toner density (image density) on the photoreceptor drum 18. The calibration processing unit 80 executes the abovementioned series of processes.

The calibration processing unit 80 also notifies the controller 90 of beginning and completion of the calibration process.

In a state in which the calibration processing unit 80 has executed the calibration process, the controller 90 (control unit) instructs the image forming unit 16 to adjust the toner density of the toner image formed on the photoreceptor drum 18 based on the toner density detected by the density sensor 56 (density detection unit).

In addition, in a state in which the calibration processing unit 80 has not executed the calibration process, the controller 90 switches the cleaning unit 57 to the cleaning state or maintains the cleaning unit 57 in the non-cleaning state, based on the toner density detected by the density sensor 56.

In addition, the controller 90 determines whether the toner density detected by the density sensor 56 is greater than the predetermined density or not, after elapse of a predetermined time period after completion of the calibration process by the calibration processing unit 80.

In addition, the controller 90 switches the cleaning unit 57 to the cleaning state in a case in which the toner density detected by the density sensor 56 is greater than a predetermined density.

The controller 90 determines whether cleaning of the conveying surface of the transfer belt 50 is necessary or not, based on the toner density measurement result consecutively and intermittently detected by the density sensor 56, even in a normal image forming on a recording material not during execution of the calibration process. If the controller 90 determines that cleaning is necessary, the controller 90 instructs the cleaning unit 57 to enter into the cleaning state.

The controller 90 includes the image density control unit 92 and a roller bias control unit 94.

Figure 6:
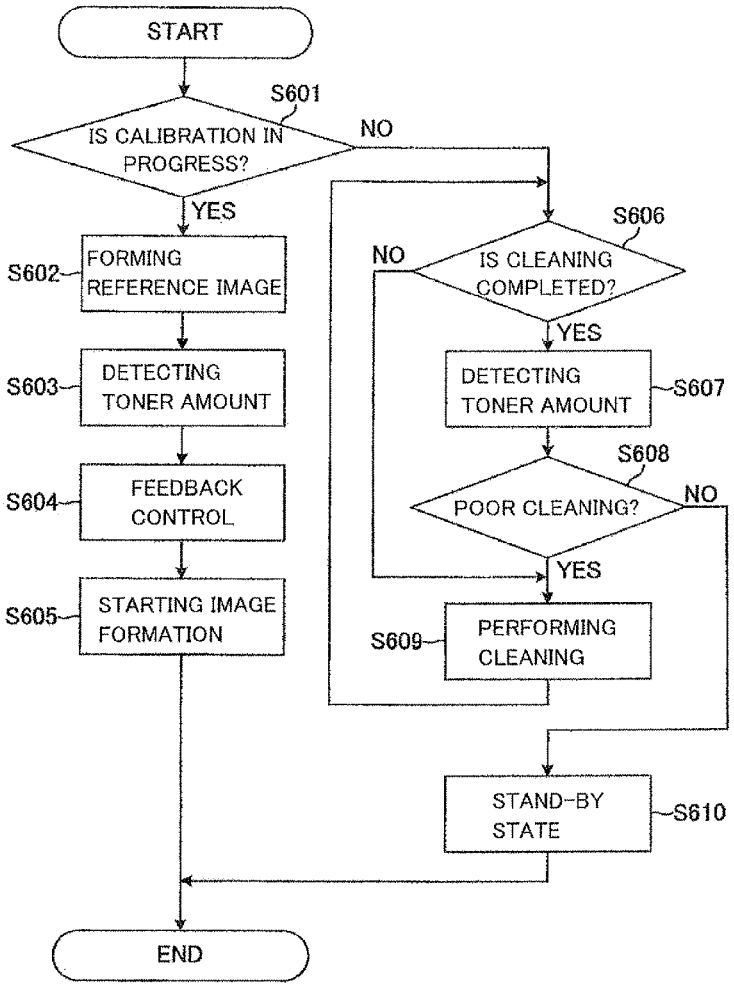
FIG. 6 is a flow chart describing operation of the printer.

FIG. 6 shows a flow chart of image density control and conveying surface optmization control by the controller 90. Operation of the printer 1 provided with the controller 90 is described hereinafter with reference to the flow chart.

In Step S601 in FIG. 6, in a case in which the controller 90 determines that the calibration is in progress, the processing advances to Steps S602 to S605, and the printer 1 (the controller 90) calibrates the image density of the photoreceptor drum 18. In other words, in Step S602, the printer 1 transfers the reference image for image adjustment formed on the photoreceptor drum 18 to the conveying surface of the transfer belt 50. The processing then advances to Step S603.

In Step S603, the image density control unit 92 detects the toner amount of the reference image based on the measurement result by the density sensor 56. Next, in Step S604, the image density control unit 92 obtains the calibration amount for the density, and outputs information related to the calibration amount thus obtained to the image forming unit 16. The processing then advances to Step S605, where the image forming unit 16 starts image formation based on image data that is externally input.

On the other hand, in Step S601, in a case in which the controller 90 determines that the calibration is not in progress, the processing advances to Steps 606 to S610, and the printer 1 executes an optimization the conveying surface of the transfer belt 50.

More specifically, in Step S606, the controller 90 determines whether cleaning of the conveying surface of the transfer belt 50 has been completed or not. In a case in which the controller 90 determines that a predetermined time period has elapsed since the cleaning unit 57 has started collecting the toner of the reference image, or that a predetermined time period has elapsed since the cleaning unit 57 has started collecting the residual toner attached to the conveying surface after completion of printing of a predetermined number of copies (in a case of YES determination), the processing advances to Step S607.

In a case in which the cleaning of the conveying surface of the transfer belt 50 has not been completed, the processing advances to Step S609. The printer 1 makes the cleaning unit 57 perform cleaning. After the cleaning, the processing advances to Step S607.

In Step S607, the roller bias control unit (control unit) 94 in FIG. 2 detects the toner amount on the conveying surface of the transfer belt 50, based on the measurement result by the density sensor 56.

Next, in Step S608, the roller bias control unit 94 determines whether the cleaning of the conveying surface of the transfer belt 50 has been successfully performed by the cleaning unit 57 or not.

And then, in a case in which the roller bias control unit 94 determines poor cleaning, in other words the residual toner remaining on the conveying surface, the processing advances to Step S609. Here, the printer 1 makes the cleaning unit 57 perform the cleaning anew (Step S609), and after resolving the poor cleaning (Step S608 No), the printer 1 enters into a stand-by state for the next image formation (Step S610).

As shown in FIG. 1, when the printer 1 performs printing, the paper is fed from the paper feeding cassette 4 in a state of being separated one by one by the paper feeding roller 46. The paper thus fed reaches the resist roller 14 via the conveying roller 10. The resist roller 14 waits for a timing for transfer of the toner image formed in the image forming unit 16 and feeds the paper to the transfer unit 30 at a predetermined feed timing, while correcting a skew of the paper.

On the other hand, an input port 91 in FIG. 2 is configured to be able to receive image data for printing from the outside. The image data is data of various images such as letters, symbols, figures, signs, diagrams and patterns. The controller 90 controls emission of laser light and the like based on the data.

More specifically, first, a discharging device (not illustrated) discharges the surface of the photoreceptor drum 18, and then the charging device 20 charges the surface of the photoreceptor drum 18.

Next, the exposure unit 15 irradiates the surface of the photoreceptor drum 18 with laser light, thereby forming the electrostatic latent image on the surface of the photoreceptor drum 18. A black toner image is formed (developed) by developing the electrostatic latent image.

The toner image is transferred to the paper conveyed by the transfer belt 50.

It should be noted that the residual toner and the like remaining on the surface of the photoreceptor drum 18 is removed by the cleaning unit 25.

The residual toner and the like remaining on the surface of the transfer belt 50 is removed by the cleaning unit 57.

Subsequently, the paper is fed toward the fixing unit 32 in a state of supporting an unfixed toner image. In the fixing portion 32, the toner image is heated and pressurized. The toner image is thus fused onto the paper. Thereafter, the paper fed from the fixing unit 32 is ejected to the ejected paper tray 36 via an ejection roller 35 and stacked in a height direction (vertical direction).

In a case of duplex printing, the paper ejected from the fixing unit 32 is drawn back to the apparatus main body 2 and a conveying direction thereof is switched at the ejection branch portion 34, thereby conveying the paper to the duplex printing paper path 38.

Next, the paper is fed toward the upstream side of the resist roller 14 and fed again toward the transfer unit 30. As a result, a toner image is transferred to an unprinted side of the paper.

As described above, in the present embodiment, the transfer belt 50 is designed for conveying the paper and runs between the photoreceptor drum 18 and the transfer roller 31. The toner image formed on the photoreceptor drum 18 is transferred to the paper placed on the conveying surface (the placing surface) of the transfer belt 50.

The toner migrating from the photoreceptor drum to the paper may also attach to the conveying surface of the transfer belt 50. The residual toner attached to the conveying surface is collected by the cleaning unit 57.

The calibration of the image density (toner density) on the photoreceptor drum 18 is executed based on the toner density of the reference image formed on the conveying surface of the transfer belt 50. More specifically, the printer 1 first forms the reference image on the conveying surface of the transfer belt 50. Next, the density sensor detects the toner amount of the reference image by irradiating the reference image with light, for example. The image density control unit 92 obtains the calibration amount for the density and instructs the image forming unit to calibrate the toner density (image density) on the photoreceptor drum 18.

Here, in the present embodiment, in addition to density detection of the reference image during calibration, the toner density on the conveying surface is detected even in a case of not forming the reference image on the conveying surface of the transfer belt 50, for further optmization of the conveying surface.

More specifically, the density sensor 56 also detects density of the residual toner on the conveying surface of the transfer belt 50 that has been cleaned by the cleaning unit 57. The density sensor 56 outputs a result of the detection to the roller bias control unit 94. The roller bias control unit 94 determines whether cleaning of the conveying surface is necessary or not. In other words, the roller bias control unit 94 determines whether an amount of toner attached to the conveying surface exceeds a predetermined amount or not, based on the result of the detection. In a case in which the roller bias control unit 94 determines that cleaning of the conveying surface is necessary based on the result of the detection by the density sensor 56, in other words in a case of poor cleaning or the like, the roller bias control unit 94 makes the cleaning unit 57 clean the conveying surface again.

As described above, as the printer 1 refers to the result of detection of the toner density on the conveying surface not only during calibration of the image density, but also after cleaning, the conveying surface of the transfer belt 50 is always cleaned more properly than in conventional printers. As a result, the printer 1 can reliably prevent contamination of a reverse face of the paper by the residual toner attached to the conveying surface.

The calibration of the image density on the photoreceptor drum 18 is executed by comparing the toner amount of the reference image on the conveying surface of the transfer belt 50 with the toner amount in a state without the reference image (reference value).

Here, due to repeated conveyance of the regular-sized paper on the conveying surface of the transfer belt 50, specific portions on the conveying surface are damaged by contact with edges of the paper, and a surface condition of the conveying surface can be easily changed. In such a state, the reference value may vary and it may be difficult to calibrate the image density unless the calibration amount for density obtained is further calibrated. However, the detection unit 70 of the density sensor 56 is disposed at a position not aligned with an edge position of the standard-sized paper and can suppress variability of the reference value.

As a result, the printer 1 can perform calibration of the image density without requiring complex calibration by measuring the toner density on the conveying surface in a superior condition for an extended time period.

The transfer belt 50 is designed to electrostatically grip and convey the paper.

First, the toner attaches to the electrostatic latent image on the photoreceptor drum 18, thereby forming a toner image on the photoreceptor drum 18. And then, by applying, to the transfer roller 31, a voltage of a reverse polarity to the toner attached to the electrostatic latent image, the toner image is transferred to the paper. In other words, the toner migrates from the photoreceptor drum 18 to the paper and may also attach to the conveying surface of the transfer belt 50. However, the cleaning unit 57 collects the residual toner attached to the conveying surface by way of an electrostatic force and can prevent contamination of a reverse face of the paper more reliably.

Furthermore, the transfer belt 50 that electrostatically grips and conveys the paper can easily prevent the paper from being wrapped around the photoreceptor drum 18, thereby improving paper separation properties, and can convey while gripping the paper, thereby stabilizing performance of a high-speed machine and the like.

Moreover, by using the transfer belt 50 for vertically conveying the paper, the paper can move toward the next fixing unit 32 in a more stable orientation than in a case of holding the paper only with the photoreceptor drum 18 and the transfer roller 31, thereby preventing failure of the apparatus due to wrapped paper during transfer and contributing to superior operation of the printer 1.

The present invention is not limited to the abovementioned embodiment and can be modified in various ways without departing from the scope of the claims.

For example, the positively charged toner has been explained as a proper charged toner in the above-mentioned embodiment; however, the present invention can be applied to a case in which the negatively charged toner is the proper charged toner.

In addition, the image forming apparatus has been exemplified as a printer in the abovementioned embodiment; however, the image forming apparatus according to the present invention can naturally be applied to a multi-functional printer, a copy machine, a facsimile machine and the like.

In any of these cases, as in the abovementioned case, an effect of reliably preventing contamination of a reverse face of the recording material can be exerted.

What is claimed is:

1. An image forming apparatus comprising: an image forming unit having an image supporting body on which an electrostatic latent image is formed and a developing unit that develops the electrostatic latent image to a toner image;

a transfer roller that is disposed to face the image supporting body;

a circular transfer belt running in a predetermined running direction, the transfer belt being interposed between the image supporting body and the transfer roller at a transfer position and having a conveying surface onto which a recording material, to which the toner image is directly transferred at the transfer position, is placed;

a cleaning unit that can be switched between a cleaning state in which the cleaning unit removes a toner attached to the conveying surface and a non-cleaning state in which the cleaning unit does not remove the toner attached to the conveying surface;

a density detection unit that is disposed on a downstream side of the transfer position and an upstream side of a cleaning position of the cleaning unit in the running direction, the density detection unit detecting toner density on the conveying surface;

a calibration processing unit that executes a calibration process for calibrating toner density of the toner image formed on the image supporting body; and a control unit that: in a state in which the calibration processing unit has executed the calibration process, instructs the image forming unit to adjust the toner density of the toner image formed on the image supporting body based on the toner density detected by the density detection unit; and in a state in which the calibration processing unit has not executed the calibration process, switches the cleaning unit to the cleaning state or maintains the cleaning unit in the non-cleaning state based on the toner density detected by the density detection unit, wherein the control unit switches the cleaning unit to the cleaning state in a case in which the toner density detected by the density detection unit is greater than a predetermined density.

2. The image forming apparatus according to claim 1, wherein the control unit determines whether the toner density detected by the density detection unit is greater than the predetermined density or not, after elapse of a predetermined time period after completion of the calibration process by the calibration processing unit.

3. The image forming apparatus according to claim 1, wherein the density detection unit detects the toner density of the transfer belt at a position not aligned with a position corresponding to an outer edge of a standard-size recording material in a width direction orthogonal to the running direction.

4. The image forming apparatus according to claim 1, wherein:

the transfer belt transfers the toner image directly to the recording material by applying a voltage having a polarity reverse to a polarity of a voltage of toner attached to the electrostatic latent image to the transfer roller; and the cleaning unit cleans the conveying surface by collecting residual toner attached to the conveying surface by an electrostatic force.

5. The image forming apparatus according to claim 1, further comprising:

a paper path that conveys the recording material vertically from a lower side to an upper side;

a driving roller; and a driven roller that is disposed obliquely above the driving roller, wherein the transfer belt is stretched around the driving roller and the driven roller thereby composing a part of the paper path, and is disposed obliquely with respect to a perpendicular direction.

* * * * *